United States Patent [19]

Flanagan

[11] 4,155,666

[45] May 22, 1979

[54] SNOWPLOWABLE PAVEMENT MARKER AND BASE MEMBER THEREFOR

[75] Inventor: Robert M. Flanagan, Lincolnshire, Ill.

[73] Assignee: Amerace Corporation, New York, N.Y.

[21] Appl. No.: 914,080

[22] Filed: Jun. 9, 1978

Related U.S. Application Data

[63] Continuation of Ser. No. 849,440, Nov. 7, 1977, which is a continuation of Ser. No. 681,857, Apr. 30, 1976, abandoned.

[51] Int. Cl.[2] ..... E01F 9/04

[52] U.S. Cl. ..... 404/16

[58] Field of Search ..... 404/16, 15, 14, 9; 350/102, 97

[56] References Cited

U.S. PATENT DOCUMENTS

| | | | |
|---|---|---|---|
| 1,896,920 | 2/1933 | Shapiro | 404/15 |
| 1,902,440 | 3/1933 | Gill | 404/16 |
| 1,927,756 | 9/1933 | Ross | 404/16 |
| 1,952,942 | 3/1934 | Ross | 404/16 |
| 1,952,943 | 3/1934 | Ross | 404/16 |
| 2,126,224 | 8/1938 | Shaffer | 404/16 |
| 2,245,336 | 6/1941 | Hamilton | 404/16 |
| 2,260,498 | 10/1941 | Wise | 404/16 |
| 2,337,793 | 12/1943 | Abbott | 404/16 |
| 3,257,552 | 6/1966 | Converso | 404/16 |
| 3,475,108 | 8/1976 | Suhr | 404/16 |
| 3,516,337 | 6/1970 | Gubela | 404/16 |
| 3,587,416 | 6/1971 | Flanagan | 404/16 |
| 3,790,293 | 2/1974 | Heenan | 404/16 |
| 3,938,963 | 2/1976 | Montgomery | 404/16 |
| 3,980,410 | 9/1976 | Suhr | 404/16 |

*Primary Examiner*—Nile C. Byers, Jr.

*Attorney, Agent, or Firm*—S. Michael Bender; Richard A. Craig

[57] ABSTRACT

A low-profile snowplowable pavement marker includes a base member generally cylindrical in outline and adapted to be installed in a drilled recess in the pavement, and having a support surface disposed in use below the level of the roadway surface for supporting thereon a cube corner reflex type reflector assembly partially recessed below the roadway surface, the top surface of the base member defining an inclined ramp rising from the roadway surface at one end of the base member toward and above the reflector assembly for protecting same from contact with snowplow blades. A monodirectional marker has an annular base with the reflector assembly mounted along a sector thereof and with arcuate ramps. A bidirectional marker has two part-annular end portions intersecting at and interconnected by a central portion carrying the reflector, and arcuate ramps converging upwardly toward the reflector from both ends of the marker. Another bidirectional marker is disc-like in shape with a flat central support surface flanked by aligned straight ramps converging upwardly from opposite ends of the marker.

33 Claims, 7 Drawing Figures

SNOWPLOWABLE PAVEMENT MARKER AND BASE MEMBER THEREFOR

This is a continuation of application Ser. No. 849,440, filed Nov. 7, 1977, which is a continuation of application Ser. No. 681,857, filed Apr. 30, 1976, now abandoned.

BACKGROUND OF THE INVENTION

The present invention relates to pavement markers of the cube corner reflex reflector type which are cleaned by the action of vehicular traffic on the roadway contacting the reflector, and in particular to such pavement markers which are suitable for use in snow areas and are, therefore, constructed so as to protect the reflector from contact with snowplow blades.

Pavement markers have become more widely accepted as permanent installations for providing visible signals which mark traffic lanes and control the flow of traffic on roadways in connection with, or in place of, conventional painted traffic lines. While a large number of such markers employ reflectors which reflect light emanating from oncoming vehicles to provide a visible signal to the operators of such oncoming vehicles, other markers have been proposed which utilize an independent light source, such as an electric lamp located within the marker, to provide a signal visible from oncoming vehicles. The term "signal means" is employed herein to denote any such marker employing a reflector, a lamp or another light source or any arrangement which provides the desired visible signal.

A snowplowable version of such a prior art pavement marker is disclosed in U.S. Pat. No. 3,790,293, issued to S. A. Heenan et al. on Feb. 5, 1974, and U.S. Pat. No. 3,809,487, issued to R. M. Flanagan on May 7, 1974, both of which patents are assigned to the assignee of the present invention. In the arrangements used in those patents, a base member of relatively high-strength material, such as metal, includes a pair of laterally spaced-apart keels which are permanently affixed to the roadway surface by insertion in grooves cut in the pavement, and a reflector body of synthetic resin material is affixed to the base member for selective removal and replacement without destruction of the base member. The base member is provided with inclined ramps for protecting the reflector body from encounters with snowplow blades.

In these prior art snowplowable pavement markers, an attempt was made to minimize the height of the pavement marker above the roadway surface by minimizing the height of the reflector body carried by the base, thereby to minimize the impact forces imparted to snowplow blades as they passed over the pavement marker. Indeed, in these prior art snowplowable pavement markers the maximum height of the marker above the roadway surface had been reduced as far as possible with existing reflex reflector bodies and installation techniques, consistent with obtaining satisfactory visibility of the pavement marker, but could not be reduced below about 0.72 inches above the pavement.

It has also been recognized in connection with these prior art pavement markers that the angle between the roadway surface and the inclined ramps of the base member should be minimized to minimize the impact forces imparted to the pavement marker and to the surrounding pavement and to snowplows by impact of snowplow blades with the inclined ramps of the pavement marker. While theoretically the ramp angle could be reduced as low as desired, the lower the angle, the longer the ramp would have to be to maintain the same maximum height and, accordingly, the longer the keel members and the longer the grooves or recesses that would have to be cut in the pavement. The longer the grooves, the greater the weakening of the pavement and the greater the time and expense required to form the grooves. Furthermore, the longer the base member, the heavier and more expensive it is. Thus, these factors serve to practically limit the ramp angle that could be obtained with these prior art pavement markers to no lower than six degrees.

In addition, the prior art pavement markers were monodirectional devices. While bidirectional reflector bodies were available, in order to mount them in a metal base member for protection from impact with snowplow blades, it would be necessary to have inclined ramps extending from the reflector body in both directions. Thus, if the same ramp angle and maximum height above the roadway surface were to be maintained, it would be necessary to virtually double the length of the base member, with the attendant disadvantages discussed above.

It has been suggested in the prior art to minimize the height of the pavement marker by partially recessing the reflector elements below the level of the roadway surface as, for example, in U.S. Pat. No. 2,260,498, issued to L. M. Wise on Oct. 28, 1941. The Wise pavement marker is a generally cylindrical body adapted to be embedded in the pavement, with a part-conical upper surface extending above the level of the roadway surface and providing an inclined surface to deflect snowplow blades from contact with the reflector bodies. But the inclined surface of the Wise pavement marker apparently is disposed at an angle in excess of 25° with the roadway surface, an angle which has proven in practice to be far too great for satisfactory operation, since the impact forces of snowplow blades against the pavement marker are so great that they destroy the pavement marker and/or severely damage the surrounding pavement. While theoretically the ramp angle of the Wise pavement marker could be reduced by increasing the diameter of his pavement marker, the enlarged recesses which would be required would unacceptably impair the integrity of the roadway and would be unduly expensive, and the size and weight of the pavement marker itself would be increased to unacceptable levels. Furthermore, the cross sectional outline of the Wise pavement marker body is not conducive to ready insertion in a recess which is cut or drilled in a finished pavement.

SUMMARY OF THE INVENTION

Therefore, there is provided in the present invention a snowplowable pavement marker which includes a base member generally cylindrical in outline adapted to be embedded in a recess which can be drilled in the pavement, and having inclined ramps which extend upwardly from the pavement, and a signal means carried by the base member below and between the ramps in such a way as to be partially recessed in use below the level of the roadway surface thereby to minimize the total height of the pavement marker above the roadway surface and the angle that the inclined ramps make with the roadway surface, but without enlarging the overall length of the pavement marker, while permitting visibility of the signal means from oncoming vehicles.

It is an important feature of the present invention to provide a snowplowable pavement marker which carries a signal means in position so that when installed on a pavement the signal means is partially recessed below the roadway surface, which pavement marker is susceptible of easy and economical installation.

More particularly, it is an important feature of the present invention that both monodirectional and bidirectional snowplowable pavement markers are provided which have a total height above the roadway surface of no greater than approximately 0.40 inches and a total overall length of no greater than approximately 9 inches, while maintaining low ramp angles and providing ease of installation.

A significant feature of this invention is the provision of a monodirectional snowplowable pavement marker which is annular in shape so as to be mountable in a core-drilled annular recess in the pavement having an outer diameter of only approximately 6.50 inches, the pavement marker having ramp angles of not greater than approximately 4° with the roadway surface and a maximum height above the roadway surface of approximately 0.37 inches.

Another feature of this invention is the provision of a bidirectional pavement marker of the character described which has an overall length of approximately 9 inches.

Still another feature of this invention is the provision of a circular bidirectional snowplowable pavement marker of minimal height and diameter and having minimal ramp angles with respect to the roadway surface.

These advantages are obtained, and it is a general object of the present invention to obtain these advantages by providing a low-profile pavement marker for use in snow areas for establishing on a finished roadway surface a marking visible from an oncoming vehicle while protecting the marking from damage by oncoming snowplow blades during snowplowing operations, the pavement marker comprising a cylindrical base member having a top surface and a bottom surface extending below a plane and a cylindrical outer side surface extending around the entire perimeter of the base member between the bottom surface and the plane, the top surface including two laterally spaced-apart inclined portions each forming an inclined ramp rising from the plane at an acute angle thereto to an uppermost portion, the base member having a support surface disposed between the inclined ramps adjacent to the uppermost portions thereof and lying below the plane, the base member in use being received and secured in a complementary cylindrical recess cut in the associated pavement with the associated roadway surface lying substantially in the plane, and signal means carried by the support surface and disposed between and below the inclined ramps so that an oncoming snowplow blade will ride up the ramps and be deflected from contact with the signal means as the snowplow blade passes over the pavement marker, the signal means facing toward the low ends of the inclined ramps and extending from below the plane to thereabove so as to be visible from oncoming vehicles and exposed to wiping action by the tires thereof when the base member is received and secured in the complementary recess, whereby the signal means is protected from contact with oncoming snowplow blades and is partially recessed in use below the level of the associated roadway surface so as to minimize the total height of the pavement marker above the roadway surface thereby to reduce the impact energy imparted to the pavement marker and to the pavement and to oncoming vehicles striking the marker.

It is another object of this invention to provide a pavement marker of the type set forth, wherein the base member is annular and has two diametrically opposed arcuate inclined ramps.

Still another object of this invention is to provide a pavement marker of the type set forth which is bidirectional, the base member having two spaced-apart end regions and a central region therebetween, and including two pairs of inclined ramps converging upwardly from the end regions toward the central region, with bidirectional signal means being supported in the central region.

Still another object of this invention is to provide a bidirectional pavement marker of the type set forth, wherein the base member has two end portions respectively formed as portions of two intersecting annuli and a central portion closing the area of intersection, the support surface being disposed in the central portion.

In connection with the foregoing object, it is another object of this invention to provide a bidirectional pavement marker of the type set forth wherein the base member is circular and includes a flat planar portion extending diametrically thereacross, the two pairs of inclined ramps respectively extending along the opposite side edges of the flat planar surface, and the support surface being recessed below the flat planar surface centrally thereof.

Further features of the invention pertain to the particular arrangement of the parts of the pavement marker whereby the above-outlined and additional operating features thereof are attained.

The invention, both as to its organization and method of operation, together with further objects and advantages thereof, will best be understood by reference to the following specification taken in connection with the accompanying drawings.

DESCRIPTION OF THE PREFERRED EMBODIMENTS

Figure 1:
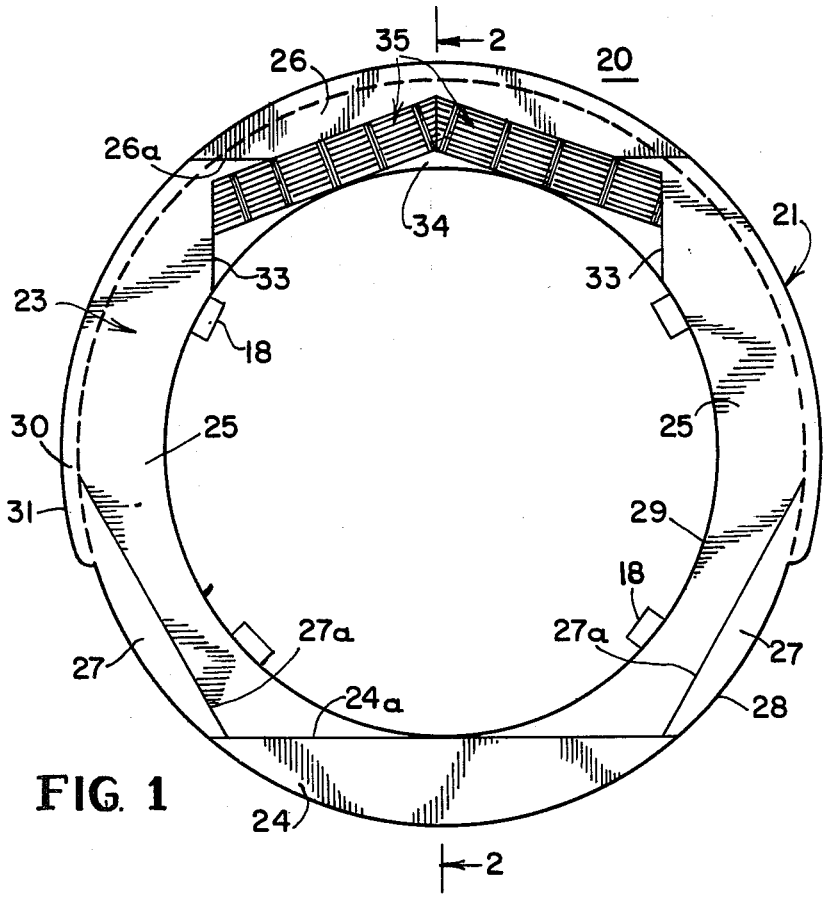
FIG. 1 is a top plan view of a pavement marker constructed in accordance with and embodying the features of a first embodiment of the present invention.
Figure 2:
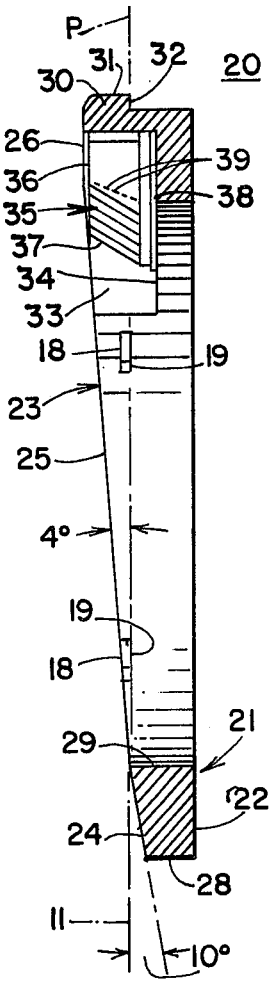
FIG. 2 is a view in vertical section taken along the line 2—2 in FIG. 1.
Figure 3:
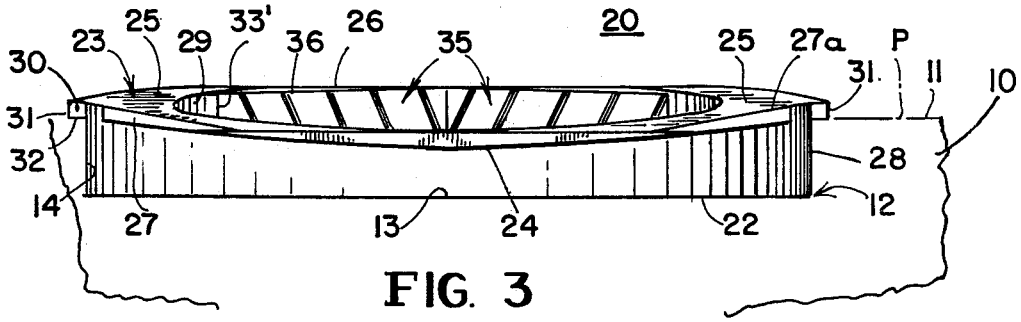
FIG. 3 is a front elevational view of the pavement marker illustrated in FIG. 1.

Referring now to FIGS. 1 through 3 of the drawings, there is illustrated a monodirectional, snowplowable pavement marker, generally designated by the numeral 20 which, in use, is embedded in the pavement 10 of a roadway so as to project above the roadway surface 11 and be visible from oncoming vehicles traveling along the roadway. The pavement marker 20 includes an annular base member, generally designated by the numeral 21, which is formed of a relatively high-strength material, such as metal, and supports thereon a reflector assembly, generally designated by the numeral 35. The base member 21 is preferably cast as an integral unit, and includes a flat annular bottom surface 22 and an irregular upper surface, generally designated by the numeral 23, the base member 21 having a plane P disposed substantially parallel to the bottom surface 22 approximately ½ inch thereabove. The upper surface 23 has an inclined front end portion 24 which intersects the plane P along a chordal line **24*a* and slopes downwardly therefrom at an acute angle of approximately 10° thereto to the front end of the base member 21. The rear end of the inclined surface 24 joins along the line 24*a* with flat coplanar upwardly inclined ramp surfaces 25, which slope upwardly and rearwardly at an angle of approximately 4° to the plane P, the ramp surfaces 25 being generally arcuate and respectively extending upwardly along the opposite sides of the base member 21**.

The upper ends of the ramp surfaces 25 intersect a flat planar top surface 26 along a line **26*a* substantially parallel to the line 24*a*, the top surface 26 being disposed substantially parallel to the plane P and spaced no more than approximately 0.40 inches thereabove. The arcuate ramp surfaces 25 are truncated along the outer side edges thereof adjacent to the front ends thereof along lines 27*a*, the upper surface 23 including curved skirt portions 27 which fall away from the truncation lines 27*a* to below the plane P. Extending upwardly from the bottom surface 22 around the entire perimeter of the base member 21 is a vertically extending outer cylindrical surface 28 which extends upwardly to the plane P except along the front end of the base member 21 where the outer cylindrical surface 28 intersects the downwardly sloping front surface 24 and skirt portions 27. Interconnecting the bottom and upper surfaces 22 and 23 and disposed coaxially with the outer cylindrical surface 28 is an inner cylindrical surface 29 which, at the front end thereof, is substantially tangent to the rear edge 24*a* of the inclined front surface 24**.

Integral with the outer cylindrical surface 28 at the upper end thereof and extending radially outwardly therefrom is a scarf member 30 which extends circumferentially around the rear portion of the base member 21 and terminates at front end portions disposed intermediate the ends of the skirt portions 27. The scarf member 30 has a part-cylindrical outer surface 31 which extends upwardly from the plane P to the top surface 23 of the base member 21, the bottom edge of the outer surface 31 being connected to the top edge of the outer cylindrical surface 28 by a flat part-annular surface 32 which lies substantially in the plane P.

Formed in the inner cylindrical surface 29 along the rear portion thereof is a recess 33 which has a flat planar bottom support surface 34 which is disposed substantially parallel to the plane P a predetermined distance therebelow. The reflector assemblies 35 are adapted to be received in the recess 33 and to be supported upon the support surface 34. More particularly, the reflector assemblies 35 are generally parallelogram-shaped bodies which respectively fit in the opposite sides of the recess 33 and are in abutting engagement with each other along the center line of the recess 33. Each of the reflector assemblies 35 includes a top wall 36 and an inclined front face 37 which covers a plurality of cube corner reflector elements 39 directed toward the front end of the base member 21. Such retrodirective reflector assemblies are well-known in the art. The reflector assembly 35 may also include a bottom pad 38 of an adhesive impact-absorbent material on the bottom surface thereof for securing the reflector assembly 35 to the support surface 34.

It is a significant feature of the present invention that the bottom pad 38 and all of the nonreflective bottom portions, and a small reflective portion along the bottom of the reflector assemblies 35 are disposed in use below the plane P, with the major portion of the reflector assemblies 35 extending above the plane P. Furthermore, the reflector assemblies 35 are of such a height that when installed upon the support surface 34 the top walls 36 are at all points disposed vertically below the base member ramp surfaces 25 and top surface 26. In other words, when the plane P is disposed horizontally, a vertical line extending upwardly from any point on the reflector assemblies 35 would intersect the upper surface 23 of the base member 21 a finite vertical distance above that point on the reflector assemblies 35.

It will be understood that the reflector assemblies 35 may be assembled with the base member 21 either before or after the base member 21 is installed on the pavement. Significantly, the adhesive attachment of the reflector assemblies 35 to the support surface 34 permits later removal and replacement of the reflector assemblies 35 in the event that they become damaged, worn or the like, without removing the base member 21 from the pavement.

In installation of the pavement marker 20 on the pavement 10, the base member 21 must be embedded in the pavement so that the roadway surface 11 will lie substantially in the plane P of the base member 21. This necessitates that the bottom portions of the base member 21 be recessed below the roadway surface 11 in a corresponding groove or recess in the pavement 10. It is a significant feature of the present invention that the pavement marker 20, and particularly the base member 21 thereof, has been constructed greatly to facilitate the installation of the pavement marker 20 on the pavement 10 so that the support surface 34 lies below the roadway surface 11, thereby to minimize the maximum height of the pavement marker 20 above the roadway surface 11, and minimize the angle between the inclined ramp surface 25 and the roadway surface 11, all without enlarging the overall length of the pavement marker 20.

More particularly, an annular recess 12 (FIG. 3) is core-drilled in the pavement 10 and is dimensioned to receive the annular base member 21 of the pavement marker 20, the recess 12 having an annular flat bottom surface 13 and coaxial, vertically extending, cylindrical, an inner side surface 14 (not shown) and an outer side. The core-drilling operation can be quickly and easily accomplished with equipment readily available on the market. This arrangement greatly enhances the strength and integrity of the pavement marker 20 and the underlying pavement 10 once the pavement marker has been installed thereon, because the circular pavement portion inside the annular recess 12 is not removed, thus providing considerable additional support and reinforcement for the base member 21 and maintaining the strength of the pavement because less material has been removed than if a cylindrical recess were auger-drilled in the pavement, as would be necessary in the case of prior art pavement markers such as those disclosed in the aforementioned U.S. Pat. No. 2,260,498. Significantly, the annular recess 12 need only be approximately ½ inch deep, the depth of the recess being only a small fraction of the diameter thereof, in contrast with the device of the aforementioned U.S. Pat. No. 2,260,498 wherein the depth of the recess cut in the pavement appears to be approximately the same as the diameter thereof.

Once the recess 12 has been cut in the pavement, it is cleaned and a suitable epoxy adhesive is deposited therein, the adhesive being of the type which adheres to both the pavement material and the material of the base member 21. Then, the base member 21 is inserted and adhesively secured in the recess 12 to a depth wherein the roadway surface 11 lies substantially in the plane P, insertion of the base member 21 to a greater depth being prevented by engagement of the bottom surface 32 of the scarf member 30 with the roadway surface 21.

It will be appreciated that when thus secured in place, the pavement marker 20 is disposed so that the bottom nonreflective portions of the reflector assemblies 35 are recessed below the roadway surface 11, while most reflective portions thereof are disposed above the roadway surface 11 so as to be clearly visible between the ramp surfaces 25 from oncoming vehicles approaching from the direction of the front end of the pavement marker 20. The recessing of the nonreflective portions of the reflector assemblies 35 below the roadway surface 21 serves to minimize the overall height of the pavement marker 20, thereby minimizing the impact force imparted to vehicle tires and snowplow blades which pass over the pavement marker 20.

The roadway surface 11 is intersected by the inclined ramp surfaces 25 at the low front ends thereof at an acute angle of approximately 4° to form an inclined ramp which serves to deflect oncoming snowplow blades upwardly out of contact with the reflector assemblies 35, which are at all points disposed below the upper surface 23 of the pavement marker 20 a distance sufficient to prevent contact with the corners of 45 degree snowplow blades. The reduced height and ramp angle of the pavement marker 20 significantly reduces the impact forces imparted thereto, and to the surrounding pavement, and to snowplows when snowplow blades impact against the pavement marker 20. Furthermore, the sloping skirt portions 27 of the upper surface 23 serve to prevent the snowplow blade from hooking on the front edges of the ramp surfaces 25.

Nevertheless, the shallowness of the pavement marker 20 and the diameter thereof is such as to permit the relatively flexible tires of oncoming vehicles to contact the front faces 37 of the reflector assemblies 35 thereby to provide a wiping action for cleaning the front faces 37. These advantages are accomplished, and a monodirectional pavement marker is provided, all with a total pavement marker length substantially less than that of the aforementioned U.S. Pat. Nos. 3,790,293 and 3,809,487, and with a maximum height above the roadway surface 11 forty-five percent less than that of the pavement markers of those prior patents, and with ramp angles one-third less than that of the prior art pavement markers.

There has also been illustrated in the drawings three equiangularly spaced-apart support tabs 18 respectively extending radially inwardly from the inner cylindrical surface 29 of the base member 21, the support tabs 18 all having bottom surfaces 19 which are coplanar and lie substantially in the plane P. The support tabs serve the same function as the scarf member 30, the bottom surfaces 19 engaging the roadway surface 11 to limit the depth to which the base member 21 can be inserted in the recess 12 in the pavement. While the support tabs 18 have been illustrated on a base member 21 which also includes a scarf member 30, it will be understood that these structures are redundant and normally either the scarf member 30 or the support tabs 18 would be provided, and not both.

Figure 4:
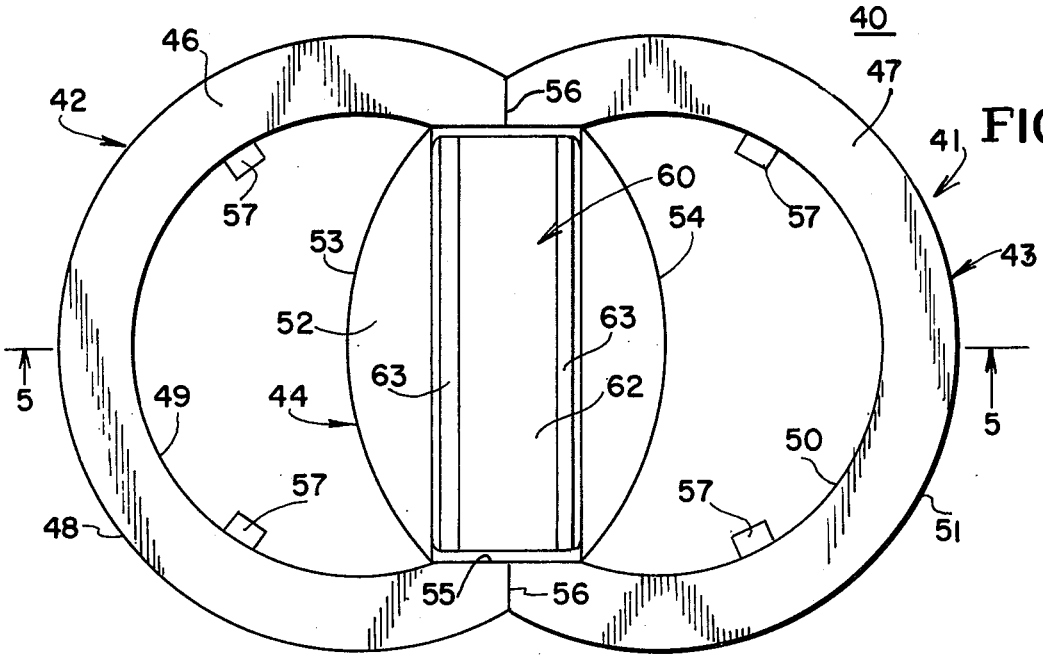
FIG. 4 is a top plan view of a pavement marker constructed in accordance with and embodying the features of a second embodiment of the present invention.
Figure 5:
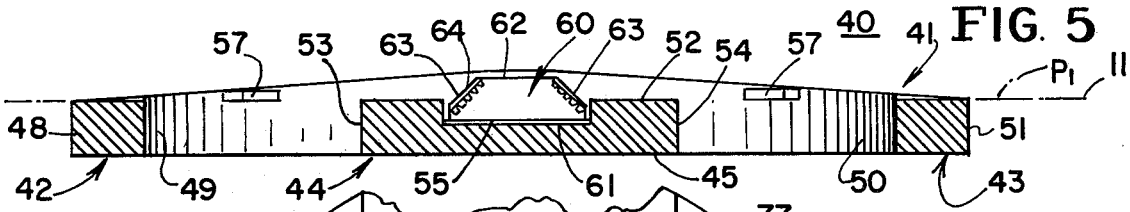
FIG. 5 is a view in vertical section taken along the line 5—5 in FIG. 4.

Referring now to FIGS. 4 and 5 of the drawings, there is illustrated a bidirectional snowplowable pavement marker, generally designated by the numeral 40, which includes a generally double cylindrical base member, generally designated by the numeral 41, which is formed of a relatively high-strength material, such as metal, and supports thereon a reflector assembly, generally designated by the numeral 60. The base member 41 includes two part-annular end portions, respectively generally designated by the numerals 42 and 43 which intersect at and are interconnected by a central portion, generally designated by the numeral 44, the base member 41 preferably being cast as a single integral unit. The base member 41 has a planar bottom surface 45 which is continuous across the end portions 42 and 43 and the central portion 44, the end portions 42 and 43 respectively having planar part-annular inclined upper surfaces 46 and 47, which respectively rise from the opposite ends of the base member 41 toward the central portion 44, where they intersect along a common transverse line 56 midway between the opposite ends of the base member 41. Interconnecting the bottom surface 45 and the part-annular top surface 46 are concentric, vertically extending outer and inner cylindrical surfaces 48 and 49, and interconnecting the bottom surface 45 and the part-annular top surface 47 are concentric, vertically extending inner and outer cylindrical surfaces 50 and 51.

The central portion 44 has a planar top surface 52 which is generally elliptical in plan outline, the top surface 52 being recessed below the adjacent portions of the inclined surfaces 46 and 47 and lying in a plane $P_1$ which is substantially parallel to the bottom surface 45 and intersects the inclined surfaces 46 and 47 at their lowest portions, adjacent to the opposite ends of the base member 41. Interconnecting the bottom surface 45 with the top surface 52 of the central portion 44 along the opposite ends thereof are two cylindrical vertically extending surfaces 53 and 54 which respectively lie along the cylinders defined by the cylindrical outer surfaces 51 and 48 of the end portions 43 and 42 and cooperate therewith to define generally the outline of two intersecting rings. Recessed in the top surface 52 of the central portion 44, centrally thereof is a generally rectangular flat support surface 55, which extends transversely substantially entirely across the central portion 44, and which is parallel to the top surface 52 and spaced a predetermined distance therebelow. Integral with the inner cylindrical surfaces 49 and 50 and projecting generally radially inwardly therefrom at spaced-apart points therealong are support tabs 57, the bottom surfaces of which lie substantially in the plane $P_1$.

The reflector assembly 60 is of the cube corner reflex type, and is preferably substantially identical to the reflector assembly which is referred to as a "Pavement Marker" and disclosed in detail in the copending U.S. application Ser. No. 681,859 of Sidney A. Heenan, entitled "Pavement Marker", and also in copending U.S. application Ser. No. 681,858 of Sidney A. Heenan, entitled "Snowplowable Pavement Marker And Method And Apparatus For Installing Same", both filed on Apr. 30, 1976, and assigned to the assignee of the present invention, the disclosures of which copending applications are incorporated herein by reference.

The reflector assembly 60 preferably has affixed to the bottom surface thereof a pad 61 of adhesive, impact-absorbent material which is adapted to be adhesively secured to the support surface 55, the reflector assembly 60 having a flat top surface 62 which is disposed below the inclined surfaces 46 and 47 of the base member 41, when the reflector assembly 60 is mounted in place on the support surface 55. The reflector assembly 60 is of the bidirectional type and includes front faces 63 inclined at an angle of approximately 45° with respect to the plane $P_1$, which faces are respectively disposed along the opposite ends of the reflector assembly 60, facing the opposite ends of the base member 41 in use, so as to be facing in the direction traveled by the oncoming traffic along the roadway. A plurality of cube corner reflector elements 64 provide the retrodirective reflection of the reflector assembly 60.

It is a significant feature of the present invention that when the reflector assembly 60 is mounted on the support surface 55, all of the bottom nonreflective portions of the reflector assembly 60, and the lower row of cube corner elements thereof, are recessed below the plane $P_1$, while the inclined front faces of the reflective portions of the reflector assembly 60 extend upwardly above the plane $P_1$ so as to be visible over the low ends of the inclined ramp surfaces 46 and 47 from oncoming vehicles traveling in either traffic direction. It is also significant that in use all points of the reflector assembly 60 are spaced vertically below the inclined surfaces 46 and 47. In other words, a vertical line extending upwardly from any point on the reflector assembly 60 would intersect the inclined surfaces 46 or 47 a finite vertical distance above that point on the reflector assembly 60.

Installation of the pavement marker 40 on the pavement 10 is similar to the installation technique described above, with respect to the pavement marker 20. However, because the pavement marker 40 includes two part-annular portions 41 and 42, there must be core-drilled in the pavement 10 two overlapping annular recesses of equal diameter for respectively accommodating therein the part-annular portions 42 and 43 of the base member 41. After these overlapping annular recesses have been drilled in the pavement, there will remain a small, generally elliptical island of pavement material between the overlapping portions of the annuli, which island can readily be knocked out with a chisel or the like to accommodate the central portion 44 of the base member 41. After the recess has thus been formed in the pavement, it is cleaned and a suitable epoxy adhesive is deposited therein, and the base member 41 is inserted and adhesively secured in the recess in the same manner as was described above with respect to the pavement marker 20, to a depth such that the roadway surface 11 lies substantially in the plane $P_1$, insertion to a greater depth being prevented by engagement of the support tabs 57 with the roadway surface 11.

When thus installed on the pavement, the pavement marker 40 has a maximum height above the roadway surface 11 of approximately 0.40 inches, and has an overall length of approximately 9 inches, the inclined surfaces 46 and 47 being disposed at an angle of approximately 6° with respect to the plane $P_1$ and the roadway surface 11, and serving to deflect oncoming snowplow blades from contact with the reflector assembly 60 as the snowplow blades pass over the pavement marker 40. This low maximum height and shallow ramp angle provide all of the advantages which were described above with respect to the pavement marker 20, the pavement marker 40 providing the added advantage of bidirectionality, all while maintaining the great ease of installation characterized by the pavement marker 20.

Figure 6:
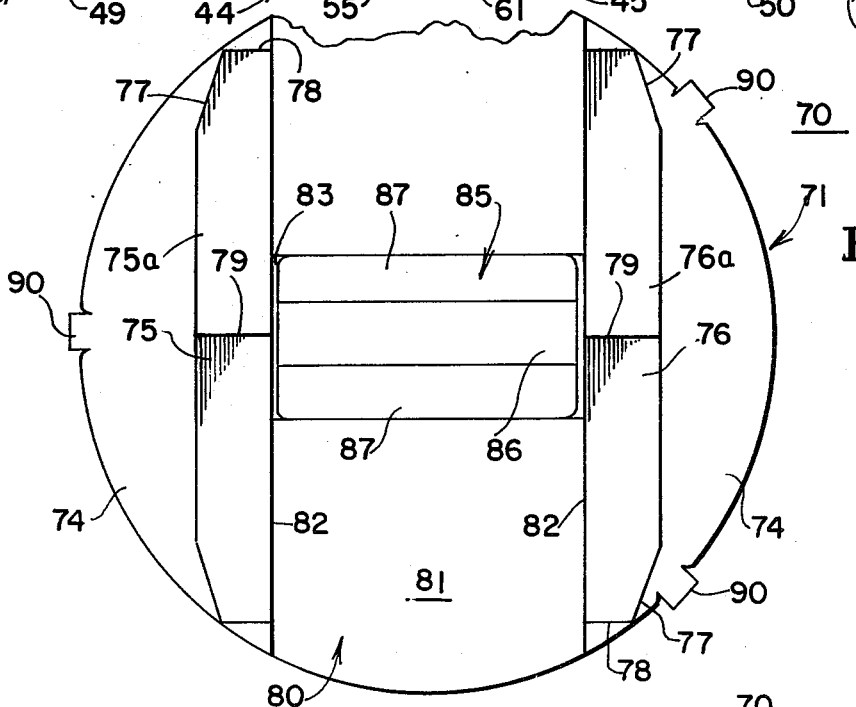
FIG. 6 is a fragmentary top plan view of a pavement marker constructed in accordance with and embodying the features of a third embodiment of the present invention.
Figure 7:
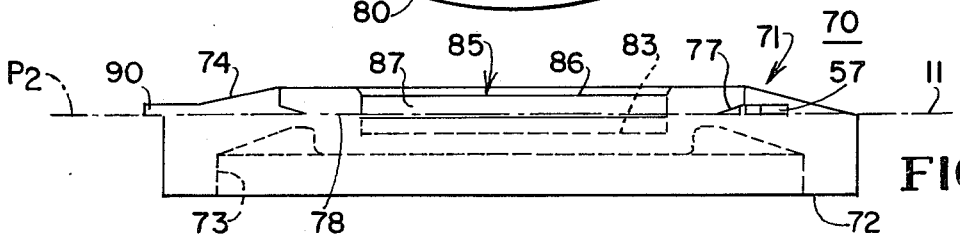
FIG. 7 is a front elevational view of the pavement marker illustrated in FIG. 6.
Figure 5:
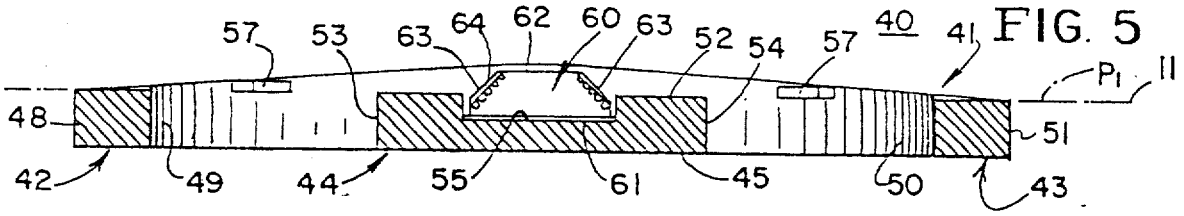

Referring now to FIGS. 6 and 7 of the drawings, there is shown another bidirectional snowplowable pavement marker, generally designated by the numeral 70, which includes a generally circular base member 71 having mounted thereon a reflector assembly, generally designated by the numeral 85. The base member 71 is preferably integrally cast as a single member from a high-strength material such as metal and is a solid, generally disc-like body, having a flat bottom surface 72 with a cylindrical recessed portion 73 therein centrally thereof for lightening the base member 71 and conserving material. The base member 71 has a part-spherical upper surface 74, which has formed therein an elongated, generally rectangular diametrically extending channel, generally designated by the numeral 80. The part-spherical surface 74 is truncated along one longitudinally extending side edge of the channel 80 to form longitudinally aligned, planar, inclined surfaces 75 and **75*a* which converge upwardly from truncated end edges 78 respectively disposed adjacent to the opposite ends of the channel 80 to uppermost portions which intersect along a transversely extending diametrical line 79. In like manner, the part-spherical surface 74 is truncated along the other side edge of the channel 80 to form longitudinally aligned, planar, inclined surfaces 76 and 76*a* which converge upwardly from truncated end edges 78 respectively disposed adjacent to the opposite ends of the channel 80 to uppermost portions which intersect along the line 79. The inclined surfaces 75 and 76 are coplanar, and the inclined surfaces 75*a* and 76*a* are coplanar. Each of the inclined surfaces 75, 75*a*, 76 and 76*a* is generally rectangular, but is tapered along the outer edge thereof at the outer end thereof along a line 77**, for a purpose to be described more fully below.

The channel 80 has a flat bottom surface 81 which extends diametrically across the base member 71 and lies in a plane $P_2$ which is substantially parallel to the bottom surface 72 and intersects the inclined surfaces 75, **75*a*, 76 and 76*a* at the low ends thereof along the flat end edges 78, the channel bottom surface 81 being connected to the inclined surfaces 75, 75*a*, 76 and 76*a* by substantially vertically extending parallel sidewalls 82. Recessed in the bottom surface 81 centrally thereof and extending between the sidewalls 82 is a flat, generally rectangular support surface 83, substantially parallel to the plane $P_2$ and spaced a predetermined distance therebelow. Formed integrally with the base member 71 and extending radially outwardly therefrom at equiangularly spaced-apart points thereon are a plurality of support tabs 90**, the bottom surfaces of which are coplanar and lie substantially in the basal plane $P_2$.

The reflector assembly 85 is a bidirectional reflector assembly and may be of the same type and mounted in the same manner as the reflector assembly 60, which was described above with respect to FIGS. 4 and 5. The reflector assembly 85 is of the cube corner reflex type and includes a bottom surface (not shown) having affixed thereto a body of adhesive, impact-absorbing material, and a top surface 86 parallel to the bottom surface, the top and bottom surfaces being interconnected by inclined front faces 87 which respectively face toward the opposite ends of the channel 80 in the directions of oncoming traffic along the roadway. The reflector assembly 85, when mounted in place on the support surface 83, has all the bottom and the lower row of cube corner elements thereof recessed below the plane $P_2$, with the inclined faces thereof extending upwardly above the plane $P_2$ so as to be clearly visible to oncoming traffic between the sidewalls 82.

Significantly, the support surface 83 is recessed to a depth such that, when the reflector assembly 85 is mounted in place thereon, the reflector assembly 85 is at all points therealong disposed vertically below the inclined surfaces 75, 75*a*, 76 and 76*a*. In other words, a vertical line extending upwardly from any point on the reflector assembly 85 will intersect the planes of the ramps 75 and 76 or 75*a* and 76*a* a finite distance vertically above that point on the reflector assembly 85.

The pavement marker 70 is installed in much the same way as was described above with respect to the pavement markers 20 and 40. More particularly, a cylindrical recess is auger-drilled in the pavement 20 to a relatively shallow depth of less than 1 inch. The recess is cleaned and epoxy adhesive is deposited therein, and the base member 71 is then inserted and adhesively secured in the recess to a depth such that the roadway surface 11 lies substantially in the plane $P_2$, insertion to a greater depth being prevented by engagement of the support flanges 90 with the roadway surface 11.

It is a significant feature of the invention that when the pavement marker 70 is thus installed on the pavement, it extends upwardly above the roadway surface 11 to a maximum height of no more than approximately 0.40 inches, the overall diameter of the base member 71 being only approximately 7 inches. The inclined surfaces 75, 75*a*, 76 and 76*a* are inclined with respect to the plane $P_2$ and with respect to the roadway surface 11 at an angle of approximately 6°, which angle is as shallow as the ramp angles of the monodirectional pavement markers of the aforementioned prior art U.S. Pat. Nos. 3,790,293 and 3,809,487, the pavement marker 70 affording the advantages of reduced height, bidirectionality, and overall length approximately one-fourth less than that of the markers of those prior patents. In operation, the inclined surfaces 75, 75*a*, 76 and 76*a* will form inclined ramps which serve to deflect snowplow blades out of contact with the reflector assembly 85, the beveled portion 77 adjacent to the ends of these ramp surfaces serving to prevent hooking of the snowplow blades on the corners of the ramp surfaces.

While the reflector assemblies 35, 60 and 85 have been illustrated herein as being cube corner type retrodirective reflector assemblies, it will be understood that other types of reflectors could also be used, if desired and, indeed, light sources or any other type of visual signal means could also be used. Furthermore, it will be appreciated that protective metal plates may be fixedly secured to the top surfaces of the reflector assemblies 35, 60 and 85, which metal plates are relatively thin so as not to extend vertically above the upper surfaces of the base members 21, 41 or 71, and which serve to protect the reflector assemblies from contact with the studs of studded snow tires, as disclosed in the before mentioned copending applications of Sidney A. Heenan.

From the foregoing, it can be seen that there has been provided an improved snowplowable pavement marker construction which includes a base member supporting a signal means thereon and having inclined ramp surfaces to protect the signal means from oncoming snowplow blades, the pavement marker having the important advantages of ramp angles at least as low as those of the prior art, a maximum height above the roadway surface considerably less than that of the prior art pavement markers, and overall length less than or equal to that of the prior art pavement markers all while affording ease of installation.

More particularly, there has been provided a snowplowable pavement marker having a base member which is generally cylindrical in outline and is adapted so that in use the signal means carried thereby is partially recessed below the roadway surface, so as to minimize the maximum height of the pavement marker above the roadway surface.

There has also been provided a monodirectional pavement marker of the character described which is annular in shape and can readily be installed in an annular recess core-drilled in the pavement, the pavement marker having a ramp angle of 4° and a maximum height above the roadway surface of no greater than approximately 0.40 inches, and being mounted in a recess having an overall diameter of approximately 6½ inches.

While there have been described what are at present considered to be the preferred embodiments of the invention, it will be understood that various modifications may be made therein, and it is intended to cover in the appended claims all such modifications as fall within the true spirit and scope of the invention.

What is claimed is:

1. A low-profile pavement marker for use in snow areas for establishing on a finished roadway surface a marking visible from an oncoming vehicle while protecting the marking from damage by oncoming snowplow blades during snowplowing operations, said pavement marker comprising a base member defining two laterally spaced-apart ramp members each having a lower portion and an upper portion and an inclined surface extending between a lowermost end and an uppermost end to form an inclined ramp, the lower portion of said base member adapted to be recessed below the roadway surface with the upper portion of each said ramp member extending above the roadway surface, and signal means adapted to be disposed between and below said ramp members with a lower portion of the signal means disposed below the roadway surface and an upper portion of the signal means disposed above the roadway surface, so that an oncoming snowplow blade will ride up said ramp members and be deflected thereby from contact with said signal means as the snowplow blade passes over said pavement marker, said signal means, including at least a part of said lower portion thereof, being operative to reflect light incident upon said signal means from an oncoming vehicle back toward said oncoming vehicle, said ramps being so configured and arranged to provide adequate space therebetween to allow vehicle tires to wipe the signal means, and whereby said signal means by being partially recessed in use below the level of the associated roadway surface minimizes the total height of said pavement marker above the roadway surface thereby to reduce the impact energy imparted to said pavement marker and the pavement and to oncoming vehicles striking said marker.

2. The pavement marker set forth in claim 1, wherein the base member has means defining a plane adapted to be substantially coincident with the roadway surface and the lower portion of the base member has a bottom surface below said plane and a side surface extending unobstructedly from the bottom surface to said plane.

3. The pavement marker set forth in claim 2, wherein the base member also has a generally upwardly facing flat support surface disposed between the ramp members and lying below said plane and said signal means is carried by the support surface.

4. The pavement marker set forth in claim 2, wherein the side surface is an outer cylindrical surface.

5. The pavement marker set forth in claim 4, wherein the outer cylindrical surface is circumferentially continuous throughout 360°.

6. The pavement marker set forth in claim 4, wherein the lower portion of said base member also has a cylindrical inner side surface coaxial with the outer cylindrical surface and extending from said bottom surface toward said plane.

7. The pavement marker set forth in claim 6, wherein said cylindrical inner side surface extends unobstructedly from said bottom surface to said plane.

8. The pavement marker set forth in claim 7, wherein said cylindrical outer and inner side surfaces are circumferentially continuous throughout 360°.

9. The pavement marker set forth in claim 8, wherein said base member is annular and said signal means is monodirectional.

10. The pavement marker set forth in claim 4, wherein said signal means is bidirectional and said base member is substantially in a solid disc-like body.

11. The pavement marker set forth in claim 6, wherein said base member has two end portions respectively formed as portions of two intersecting annuli and said support surface is located in a central portion which closes the area of intersection of the intersecting annuli, each of said two annuli has outer and inner coaxial cylindrical surfaces extending from the bottom surface to said plane and said signal means is bidirectional.

12. The pavement marker set forth in claim 1, wherein said ramps make an angle of not greater than approximately 6° with the roadway surface.

13. The pavement marker set forth in claim 1, wherein the height of the pavement marker above the roadway surface is not greater than approximately 0.40 inches.

14. The pavement marker set forth in claim 1, wherein the length of said base member is not greater than approximately 9 inches.

15. The pavement marker set forth in claim 1, wherein the base member has means including a downwardly facing surface defining a plane, said downwardly facing surface adapted to engage the roadway surface to limit the depth to which the lower portion of the base member is recessed below the roadway surface.

16. The pavement marker set forth in claim 15, wherein said base member has a bottom surface and a side surface extending unobstructedly from the bottom surface to said plane.

17. The pavement marker set forth in claim 1, wherein both the upper portion of the signal means and at least a part of the lower portion thereof are operative to reflect light incident upon the upper portion of the signal means from an oncoming vehicle back toward said vehicle and said ramps are so configured and arranged to provide adequate space therebetween to allow vehicle tires to wipe at least the upper portion of the signal means.

18. A base member for use as a component of a low-profile pavement marker for use in snow areas for establishing on a finished roadway surface a marking visible from an oncoming vehicle while protecting the marking from damage by oncoming snowplow blades during snowplowing operations, said base member having two laterally spaced-apart ramp members each having a lower portion and an upper portion and an inclined surface extending between a lowermost end and an uppermost end to form an inclined ramp, the lower portion of said base member adapted to be recessed below the roadway surface with the upper portion of each said ramp member extending above the roadway surface, said base member further having a support member located between and below the upper ends of said ramp members and providing an upwardly facing, substantially flat support surface adapted to be recessed below the roadway surface and to carry signal means thereon with the signal means disposed between and below said ramp members with a lower portion of the signal means disposed below the roadway surface and an upper portion of the signal means disposed above the roadway surface so that an oncoming snowplow blade will ride up said ramp members and be deflected thereby from contact with said signal means as the snowplow blade passes over said pavement marker, said ramps being so configured and arranged to provide adequate space therebetween to allow vehicle tires to wipe the signal means, and whereby said support surface by being recessed in use below the level of the associated roadway surface minimizes the total height of said pavement marker above the roadway surface thereby to reduce the impact energy imparted to said pavement marker and the pavement and to oncoming vehicles striking said marker.

19. The base member set forth in claim 18, wherein the lower portion of the base member has a bottom surface adapted to be below the roadway surface and a side surface extending unobstructedly from the bottom surface to the roadway surface.

20. The base member set forth in claim 19, wherein the base member has means defining a plane adapted to be substantially coincident with the roadway surface.

21. The base member set forth in claim 19, wherein the side surface is an outer cylindrical surface.

22. The base member set forth in claim 21, wherein the outer cylindrical surface is circumferentially continuous throughout 360°.

23. The base member set forth in claim 21, wherein the lower portion of said base member also has a cylindrical inner side surface coaxial with the outer cylindrical surface and extending from said bottom surface toward said plane.

24. The base member set forth in claim 23, wherein said cylindrical inner side surface extends unobstructedly from said bottom surface to said plane.

25. The base member set forth in claim 24, wherein said cylindrical outer and inner side surfaces are circumferentially continuous throughout 360°.

26. The base member set forth in claim 25, wherein said base member is annular.

27. The base member set forth in claim 21, wherein said base member is substantially in a solid disc-like body.

28. The base member set forth in claim 23, wherein said base member has two end portions respectively formed as portions of two intersecting annuli and said support member and support surface are located in a central portion which closes the area of intersection of the intersecting annuli and each of said two annuli has outer and inner coaxial cylindrical surfaces extending from the bottom surface to said plane.

29. The base member set forth in claim 18, wherein said ramps make an angle of not greater than approximately 6° with the roadway surface.

30. The base member set forth in claim 18, wherein the height of the base member above the roadway surface is not greater than approximately 0.40 inches.

31. The base member set forth in claim 18, wherein the length of said base member is not greater than approximately 9 inches.

32. The base member set forth in claim 18, wherein the base member has means including a downwardly facing surface defining a plane, said downwardly facing surface adapted to engage the roadway surface to limit the depth to which the lower portion of the base member is recessed below the roadway surface.

33. The base member set forth in claim 32, wherein said base member has a bottom surface and a side surface extending unobstructedly from the bottom surface to said plane.

* * * * *

UNITED STATES PATENT AND TRADEMARK OFFICE

CERTIFICATE OF CORRECTION

PATENT NO. : 4,155,666

DATED : May 22, 1979

INVENTOR(S) : Robert M. Flanagan

It is certified that error appears in the above-identified patent and that said Letters Patent are hereby corrected as shown below:

On the Title Page, Heading [63], line 1, between the last comma (,) and "which" insert --abandoned,--; Heading [56], line 13 (eleventh item), change "3,475,108" to --3,975,108--.

Column 1, line 5, between the second comma (,) and "which" insert --now abandoned,--.

Column 6, line 53, delete the last comma (,); line 54, change the line to be --inner and outer side surfaces, one of which is shown at 14.--.

UNITED STATES PATENT AND TRADEMARK OFFICE

CERTIFICATE OF CORRECTION

PATENT NO. : 4,155,666

DATED : May 22, 1979

INVENTOR(S) : Robert M. Flanagan

It is certified that error appears in the above-identified patent and that said Letters Patent are hereby corrected as shown below:

Substitute FIG. 5 as shown on the attached sheet for FIG. 5 of the patent as printed.

Column 11, line 4, between "bottom" and "and" insert --nonreflective portions--.

Signed and Sealed this

*Thirtieth* Day of *October 1979*

[SEAL]

*Attest:*

RUTH C. MASON
*Attesting Officer*

LUTRELLE F. PARKER
*Acting Commissioner of Patents and Trademarks*